US006075404A

United States Patent [19]

Shindoh et al.

[11] Patent Number: 6,075,404

[45] Date of Patent: Jun. 13, 2000

[54] SUBSTRATE BIASING CIRCUIT AND SEMICONDUCTOR INTEGRATED CIRCUIT DEVICE

[75] Inventors: Yasuyuki Shindoh, Miyagi; Hirofumi Watanabe, Hyogo, both of Japan

[73] Assignee: Ricoh Company, Ltd., Tokyo, Japan

[21] Appl. No.: 09/056,748

[22] Filed: Apr. 8, 1998

[30] Foreign Application Priority Data

Apr. 11, 1997 [JP] Japan ..... 9-093721

[51] Int. Cl.[7] ..... G05F 3/02

[52] U.S. Cl. ..... 327/537; 327/535

[58] Field of Search ..... 327/530, 534, 327/535, 536, 537, 538, 540, 541, 543

[56] References Cited

U.S. PATENT DOCUMENTS

| | | | |
|---|---|---|---|
| 5,329,168 | 7/1994 | Sugibayashi et al. | 307/296.1 |
| 5,347,172 | 9/1994 | Cordoba et al. | 307/296.2 |
| 5,506,540 | 4/1996 | Sakurai et al. | 327/535 |
| 5,694,072 | 12/1997 | Hsiao et al. | 327/537 |

FOREIGN PATENT DOCUMENTS 6-139779 5/1994 Japan .

*Primary Examiner*—Jung Ho Kim

*Attorney, Agent, or Firm*—Dickstein Shapiro Morin & Oshinsky LLP

[57] ABSTRACT

A substrate biasing circuit includes a logical threshold potential output circuit including transistors formed on a semiconductor substrate and generating a logical threshold potential. A potential compare control circuit compares the logical threshold potential with a reference potential and generating a control potential based on a comparison result. A substrate bias generating circuit generates, as long as the control potential indicates that the logical threshold potential is not equal to the reference potential, a substrate potential applied to the semiconductor substrate so that the logical threshold potential is equal to the reference potential, and stops operating after the logical threshold potential becomes equal to the reference potential. A switch circuit breaks a pass-through current path formed in the logical threshold potential output circuit when the control potential indicates that the logical threshold potential becomes equal to the reference potential.

11 Claims, 7 Drawing Sheets

SUBSTRATE BIASING CIRCUIT AND SEMICONDUCTOR INTEGRATED CIRCUIT DEVICE

BACKGROUND OF THE INVENTION

Field of the Invention

The present invention generally relates to the semiconductor integrated circuit technology, and more particularly to a substrate biasing circuit.

Recently, there has been a tendency for the amount of power consumed in integrated circuits used to semiconductor elements due to fine scaling and speeding up of semiconductor elements. There has also been a demand to reduce the power consumption due to increased applications of the integrated circuits to devices driven by a battery. In order to reduce the power consumption, it is attempted to reduce the power supply voltage of the integrated circuits. However, as the power supply voltage is reduced, a problem due to differences among the threshold voltages of the individual transistors becomes conspicuous.

It is very difficult to avoid the occurrence of the differences among the individual transistors due to variations in the conditions of the production process. As described above, the problem caused by the differences among the threshold voltages of the transistors becomes conspicuous when the power supply voltage is reduced. For example, if the power supply voltage is as comparatively high as 3.3 V and the threshold voltage is varied by +0.15 V, the circuit driving speed is reduced by approximately 5%. If the power supply voltage is as comparatively low as 1 V and the threshold voltage is varied by +0.15 V, the circuit driving speed is reduced by 200%. Further, variations in the threshold voltage causes problems such as an increase in the leakage current and an increase in the amount of power consumed when the circuits are in the standby state.

A proposal directed to solving the above problems is described in Japanese Laid-Open Patent Application No. 6-139779 (IPC G11C 11/413). The proposed technique is to detect the threshold voltages of MOS transistors and control the substrate bias so as to compensate for a deviation in the detected threshold voltages. As shown in FIG. 1, a CMOS inverter 100 made up of a P-channel MOS transistor and an N-channel MOS transistor is arranged to detect the threshold voltage of the CMOS inverter based on the threshold voltages of the MOS transistors. An input terminal 100*a* of the CMOS inverter and an output terminal 100*b* thereof are connected together. Hence, a constant voltage determined by the threshold voltages of the MOS transistors can be obtained at the output terminal 100*b*. The above constant voltage, that is, the threshold voltage of the CMOS inverter, is then compared with a given reference voltage by a comparator circuit not shown.

However, the above arrangement in which the input terminal 100*a* and output terminal 100*b* of the inverter 100 are short-circuited, the operating point of the inverter 100 is located at point a shown in FIG. 2, and a large amount of pass-through current flows in the CMOS inverter. The horizontal axis of the graph of FIG. 2 denotes the input voltage of the CMOS inverter 100, and the vertical axis thereof denotes the output voltage thereof. When the input voltage of the inverter 100 increases to Vthinv, the output voltage is changed from a high level to a low level. At this time, a large amount of the pass-through current flows in the inverter 100.

SUMMARY OF THE INVENTION

It is a general object of the present invention to eliminate the above disadvantages.

A more specific object of the present invention is to provide a substrate biasing circuit having no pass-through current and to provide a semiconductor integrated circuit device equipped with such a substrate biasing circuit.

The above objects of the present invention are achieved by a substrate biasing circuit comprising: a logical threshold potential output circuit including transistors formed on a semiconductor substrate and generating a logical threshold potential; a potential compare control circuit comparing the logical threshold potential with a reference potential and generating a control potential based on a comparison result; a substrate bias generating circuit which generates, as long as the control potential indicates that the logical threshold potential is not equal to the reference potential, a substrate potential applied to the semiconductor substrate so that the logical threshold potential is equal to the reference potential and which stops operating after the logical threshold potential becomes equal to the reference potential; and a switch circuit which breaks a pass-through current path formed in the logical threshold potential output circuit when the control potential indicates that the logical threshold potential becomes equal to the reference potential.

The substrate biasing circuit may further comprise a reset circuit which causes the switch circuit to form the pass-through current path in the logical threshold potential output circuit.

The substrate biasing circuit may be configured so that: the switch circuit comprises a first N-channel MOS transistor, and the logical threshold potential output circuit comprises a first P-channel MOS transistor and a second N-channel MOS transistor; the first P-channel MOS transistor, the first N-channel MOS transistor and the second N-channel MOS transistor are connected in series in that order; the logical threshold potential is obtained at a node at which a gate and drain of the first P-channel MOS transistor, a gate of the second N-channel MOS transistor, and a drain of the first N-channel MOS transistor are connected together; and a gate of the first N-channel MOS transistor is connected to an output terminal of the potential compare control circuit.

The substrate biasing circuit may further comprise a second P-channel MOS transistor having a source receiving a high-potential power supply voltage, a drain connected to the gate of the first N-channel MOS transistor, and a gate receiving a reset input.

The substrate biasing circuit may be configured so that: the logical threshold potential output circuit comprises a first P-channel MOS transistor and a first N-channel MOS transistor, and the switch circuit comprises a second P-channel MOS transistor; the first P-channel MOS transistor, the second P-channel MOS transistor and the first N-channel MOS transistor are connected in series in that order; the logical threshold potential is obtained at a node at which a gate and drain of the first N-channel MOS transistor, a gate of the first P-channel MOS transistor, and a drain of the second P-channel MOS transistor are connected together; and a gate of the second P-channel MOS transistor is connected to an output terminal of the potential compare control circuit.

The substrate biasing circuit may further comprise a second N-channel MOS transistor having a source receiving a low-potential power supply voltage, a drain connected to the gate of the second P-channel MOS transistor, and a gate receiving a reset input.

The substrate biasing circuit may further comprise a reference potential output circuit outputting the reference potential.

The above objects of the present invention are also achieved by a semiconductor integrated circuit device comprising: a semiconductor substrate; and a substrate biasing circuit formed on substrate. The substrate biasing circuit comprises: a logical threshold potential output circuit including transistors formed on the semiconductor substrate and generating a logical threshold potential; a potential compare control circuit comparing the logical threshold potential with a reference potential and generating a control potential based on a comparison result; a substrate bias generating circuit which generates, as long as the control potential indicates that the logical threshold potential is not equal to the reference potential, a substrate potential applied to the semiconductor substrate so that the logical threshold potential is equal to the reference potential and which stops operating after the logical threshold potential becomes equal to the reference potential; and a switch circuit which breaks a pass-through current path formed in the logical threshold potential output circuit when the control potential indicates that the logical threshold potential becomes equal to the reference potential.

The semiconductor integrated circuit device may be configured so that the substrate bias generating circuit generates the substrate potential applied to a P-type region formed in the semiconductor substrate.

The semiconductor integrated circuit device may be configured so that the substrate bias generating circuit generates the substrate potential applied to an N-type region formed in the semiconductor substrate.

The semiconductor integrated circuit device may be configured so that: the substrate bias generating circuit generates the substrate potential applied to one of a P-type region and an N-type region formed in the semiconductor substrate; and the semiconductor integrated circuit device comprises another substrate bias generating circuit which generates another substrate potential applied to the other one of the P-type region and the N-type region.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

A description will now be given of embodiments of the present invention.

Figure 3:
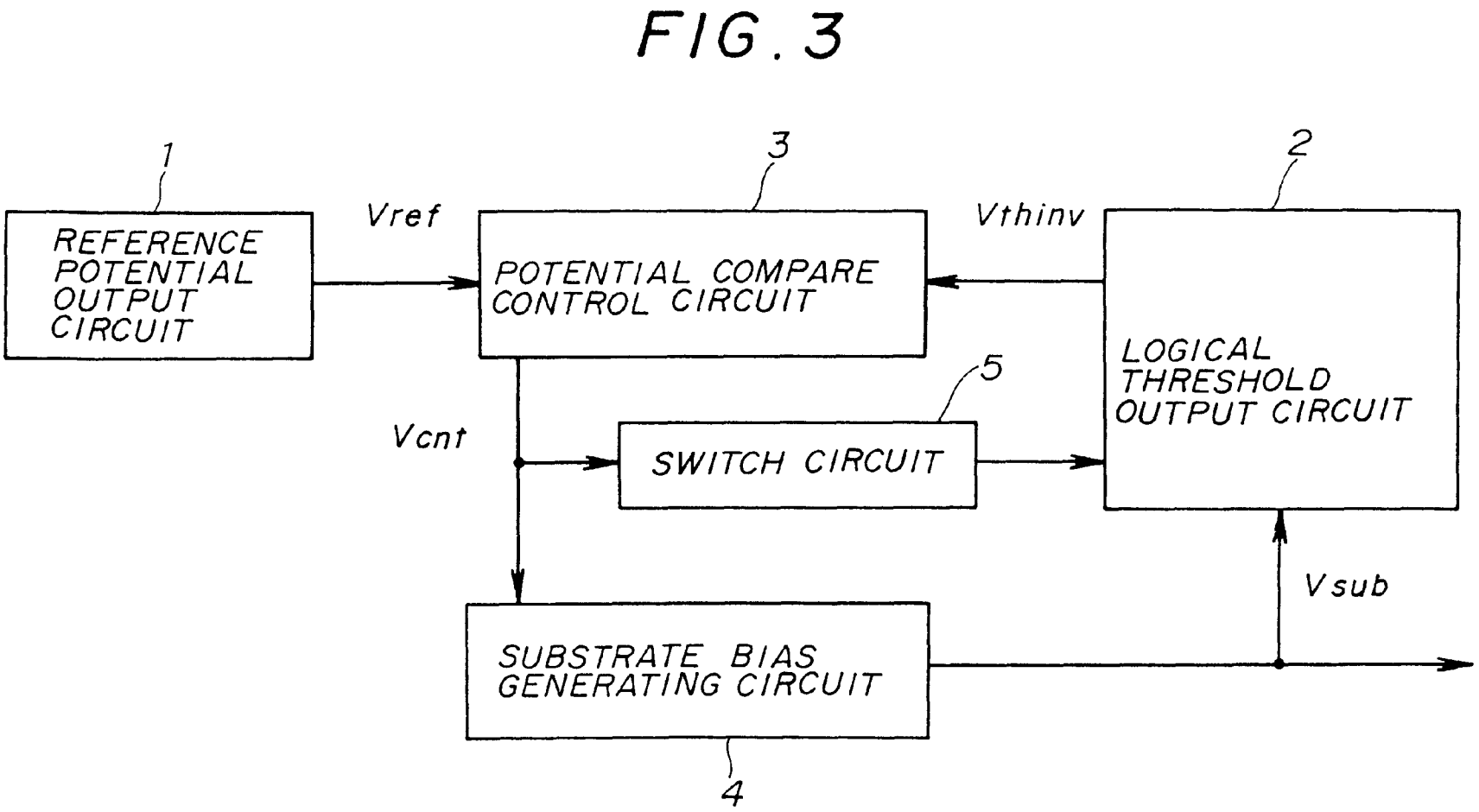
FIG. 3 is a block diagram of a substrate biasing circuit of the present invention.

FIG. 3 is a block diagram of a substrate biasing circuit according to the present invention. A reference potential output circuit 1 outputs a predetermined reference voltage Vref. The reference potential output circuit 1 is made up of some resistors, and is supplied with a power supply voltage VDD. The potential obtained at a connection node between adjacent resistors is used as the reference voltage Vref. The reference voltage Vref can be set to an arbitrary level, and equal to, for example, ½ of the power supply voltage VDD.

Figure 1:
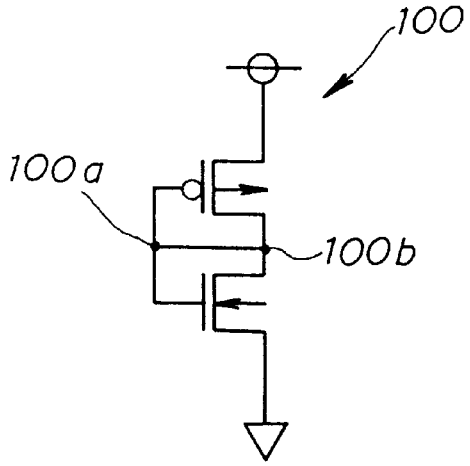
FIG. 1 PRIOR ART
FIG. 1 is a circuit diagram of a CMOS inverter used to detect the threshold voltages of the transistors.
Figure 2:
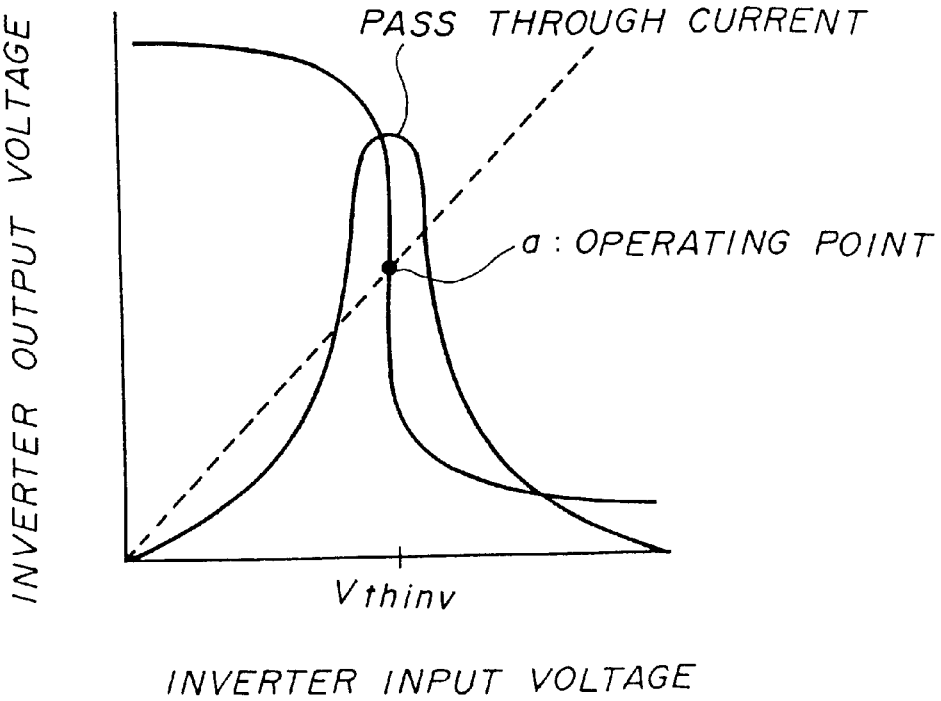
FIG. 2 PRIOR ART
FIG. 2 is a graph showing a problem caused in the circuit shown in FIG. 1.

A logical threshold potential output circuit 2 is made up of transistors formed in a semiconductor substrate, and outputs a logical threshold potential Vthinv. The logical threshold potential output circuit 2 is supplied with a substrate potential Vsub, which will be described later. The logical threshold potential Vthinv is changed by the substrate potential Vsub. As the substrate potential Vsub becomes greater, the logical threshold potential Vthinv is increased. As the substrate potential Vsub becomes smaller, the logical threshold potential Vthinv is decreased. For example, the logical threshold potential output circuit 2 includes a CMOS inverter as shown in FIG. 1.

A potential compare control circuit 3 compares the logical threshold potential Vthinv output by the logical threshold potential output circuit 2 with the reference potential Vref output by the reference potential output circuit 1, and outputs a control potential Vcnt based on the comparison result to a substrate bias generating circuit 4. For example, as long as the logical threshold potential Vthinv is lower than the reference potential Vref, the control potential Vcnt is at a high level. When the logical threshold potential Vthinv is switched to a low level, the control potential Vcnt is switched to a low level.

The substrate bias generating circuit 4 receives the above control voltage Vcnt, and generates, as long as the control potential Vcnt does not indicate that the logical threshold potential Vthinv is equal to the reference potential Vref, a substrate potential Vsub so that the logical threshold potential Vthinv is equal to the reference potential Vref. The control potential Vsub thus generated is applied to a semiconductor substrate (not shown in FIG. 3). For example, as long as the control potential Vcnt is at the high level, the substrate potential Vsub is made to gradually become greater. When the logical threshold potential Vthinv and the reference potential Vref become equal to each other, the control potential Vcnt output by the potential compare control circuit 3 is switched to the low level, so that the substrate bias generating circuit 4 stops operating. The substrate potential Vsub obtained at this time is held in a hold circuit (not shown in FIG. 3), so that the substrate biasing of the logical threshold potential output circuit 2 is continuously carried out. The hold circuit may be a capacitor formed in the semiconductor substrate or a parasitic capacitor formed in the substrate.

A switch circuit 5 breaks a pass-through current path formed in the logical threshold potential output circuit 2 when the control potential Vcnt is switched to the low level. For example, as long as the control potential Vcnt is at the high level, the switch circuit 5 is in the disabled state and the operation of the logical threshold potential output circuit 2 is maintained. When the potentials Vthinv and Vref become equal to each other and the control potential Vcnt is switched to the low level, the switch circuit 5 breaks the pass-through current path in the logical threshold potential output circuit 2.

After the logical threshold potential Vthinv becomes equal to the reference potential Vref, the pass-through current path formed in the logical threshold potential output circuit 2 is broken by the switch circuit 5. Hence, no pass-through current flows in the logical threshold value output circuit 2 and the power consumption can be reduced.

A description will be given of first and second embodiments of the substrate biasing circuit according to the present invention. The first embodiment of the present invention is directed to controlling the substrate bias (P-type well) for N-channel MOS transistors, and the second embodiment thereof is directed to controlling the substrate bias (N-type well) for P-channel MOS transistors.

Figure 4:
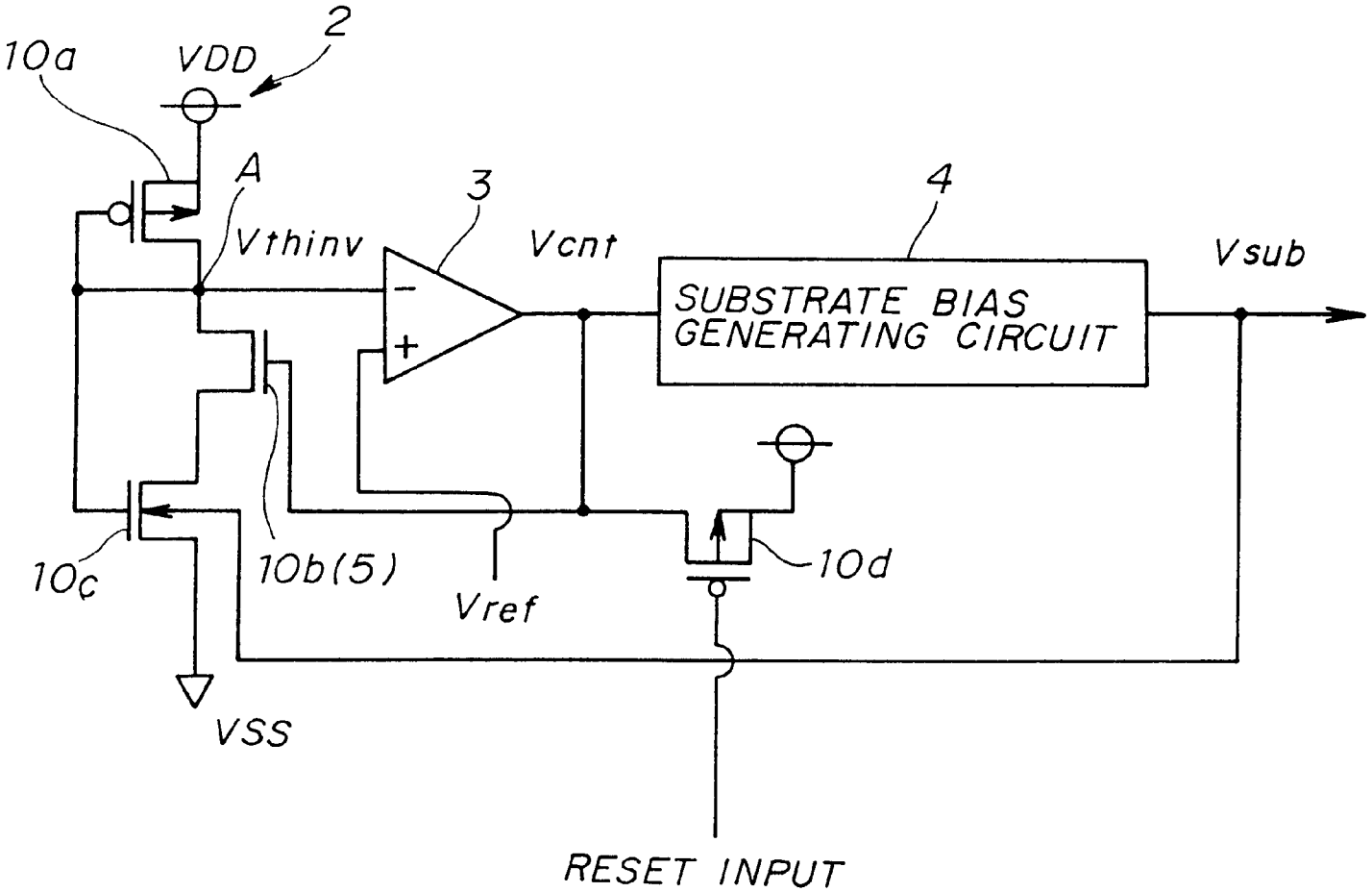
FIG. 4 is a circuit diagram of a substrate biasing circuit according to a first embodiment of the present invention.

FIG. 4 is a circuit diagram of the first embodiment of the present invention. The logical threshold potential output circuit 2 is made up of a first P-channel MOS transistor 10*a* and a first N-channel MOS transistor 10*c*. The switch circuit 5 is formed of a second N-channel MOS transistor 10*b*. The MOS transistors 10*a*, 10*b* and 10*c* are connected in series between a high-potential power supply voltage VDD and a low-potential power supply voltage (ground, for example) VSS in that order. The gate and drain of the first P-channel MOS transistor 10*a*, the gate of the second N-channel MOS transistor 10*c*, and the drain of the first N-channel MOS transistor 10*b* are connected together to form a connection node A from which the logical threshold potential Vthinv is output. The gate of the first N-channel MOS transistor 10*b* is connected to the output terminal of the potential compare control circuit 3, which is formed by an operational amplifier.

The first N-channel MOS transistor 10*b* is interposed between the first P-channel MOS transistor 10*a* and the second N-channel MOS transistor 10*c*. As long as the control potential Vcnt output by the potential compare control circuit 3 is at the high level, the first N-channel MOS transistor 10*b* is ON, and the drain of the first P-channel MOS transistor 10*a* and the drain of the second N-channel MOS transistor 10*c* are connected together. Hence, the logical threshold potential Vthinv is output by the logical threshold potential output circuit 2 via the connection node A. It will be noted that the series circuit of the MOS transistors 10*a*, 10*b* and 10*c* may serve as a pass-through current path in the logical threshold potential output circuit 2. When the control potential Vcnt is switched to the low level, the first N-channel MOS transistor 10*b* is turned OFF, and the pass-through current path is broken.

The substrate bias generating circuit 4 continues to supply the substrate bias potential to the substrate bias (P-type well) for the second N-channel MOS transistor 10*c* after the control potential Vcnt is switched to the low level.

The above-mentioned first embodiment of the present invention has a second P-channel MOS transistor 10*d*, which is an optional element and functions as a reset circuit. The gate of the second P-channel MOS transistor 10*d* receives a reset input, which may be generated by an internal circuit (not shown) of a device equipped with the substrate biasing circuit shown in FIG. 4 or may be supplied from an external circuit provided outside of the device. The source of the second P-channel MOS transistor 10*d* receives the power supply voltage VDD, and the drain thereof is connected to the gate of the first N-channel MOS transistor 10*b* and the input terminal of the substrate bias generating circuit 4. When the substrate biasing circuit shown in FIG. 4 is reset, the reset signal is switched to the low level. Thus, the second P-channel MOS transistor 10*d* is turned ON and thus the first N-channel MOS transistor 10*b* is forced to be turned ON. Further, the high-level control potential Vcnt is applied to the substrate bias generating circuit 4. Hence, the substrate bias potential applied to the second N-channel transistor 10*c* is reset.

The substrate biasing circuit shown in FIG. 4 operates as follows.

When the logical threshold potential Vthinv is lower than the reference potential Vref, the control potential Vcnt output by the potential compare control circuit 3 is at the high level, and the first N-channel MOS transistor 10*b* is turned ON. The substrate bias generating circuit 4 generates the substrate voltage Vsub so that the potential of the P-type well of the second N-channel MOS transistor 10*c* becomes deep. Hence, the threshold of the second N-channel MOS transistor 10*c* is increased and the logical threshold potential Vthinv of the CMOS inverter made up of the first P-channel MOS transistor 10*a* and the second N-channel MOS transistor 10*c* is also increased. When the logical threshold potential Vthinv becomes equal to or higher than the reference potential Vref, the control potential Vcnt output by the potential compare control circuit 3 is switched to the low level, and thus the substrate bias generating circuit 4 stops operating. The substrate potential Vsub obtained at that time is held. Further, the first N-channel MOS transistor 10*b* is turned OFF, and the pass-through current path formed in the logical threshold potential output circuit 2 is broken. Hence, it is possible to prevent the pass-through current from flowing in the threshold potential output circuit 2.

The second P-channel MOS transistor 10*d*, which is an optional element as described previously, can turn ON the first N-channel MOS transistor 10*b* in response to the reset signal even when the control potential Vcnt output by the potential compare control circuit 3 is at the low level. Hence, the reset input can be used not only to activate the initial operation of the substrate biasing circuit but also to restart the substrate bias generating circuit 4 if the substrate potential Vsub held in the hold circuit (for example, a capacitor) provided in the circuit 4 is decreased.

When the switch circuit 5 is turned OFF and the logical threshold potential output circuit 2 stops operating, the threshold potential of the first P-channel MOS transistor 10*a* is input, as the logical threshold potential Vthinv, to the potential compare control circuit 3. However, the threshold potential of the first P-channel MOS transistor 10*a* is higher than the reference potential Vref. Hence, the substrate bias generating circuit 4 is maintained in the stopped state and the substrate potential Vsub can be maintained.

The first embodiment of the present invention is on condition that the logical threshold potential Vthinv is lower than the reference potential Vref at the commencement of the operation of the substrate biasing circuit. The above condition can be realized by adjusting the process conditions for producing the elements so that the reference potential Vref is greater than the sum of the logical threshold potential Vthinv and a constant $+\alpha$. That is, the adjustment of the process conditions is based on the following consideration. That is, it is not inevitable to avoid occurrence of original variations in the logical threshold potential (in the not-biased state) due to variations in the conditions of the production process. Hence, it is considered that the threshold potential originally varies within the range $+\alpha$.

Figure 5:
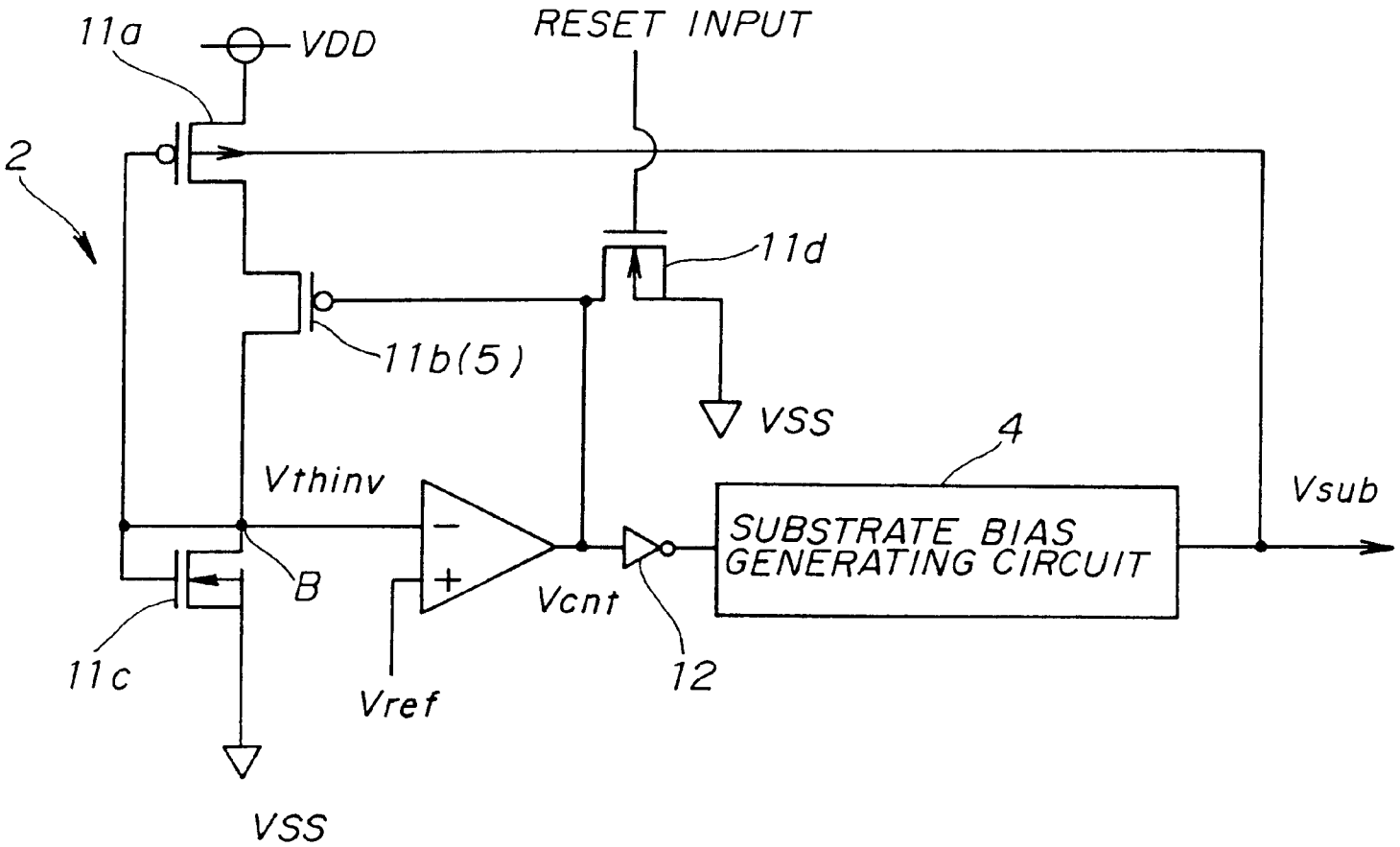
FIG. 5 is a circuit diagram of a substrate biasing circuit according to a second embodiment of the present invention.

A description will now be given, with reference to FIG. 5, of the second embodiment of the present invention. As shown in FIG. 5, a first P-channel MOS transistor 11*a*, a second P-channel MOS transistor 11*b* and a first N-channel MOS transistor 11*c* are connected in series in this order. The gate of the first P-channel MOS transistor 11*a*, the gate of the first N-channel MOS transistor 11*c*, the drain of the second P-channel MOS transistor 11*b* and the first N-channel MOS transistor 11*c* are connected together to form a connection node B from which the logical threshold potential generated by the logical threshold potential output circuit 2 is output. The gate of the second P-channel MOS transistor 11*b* is connected to the output terminal of the potential compare control circuit 3. The second P-channel MOS transistor 11*b* forms the switch circuit 5 shown in FIG. 3.

More particularly, the first P-channel MOS transistor 11*a* and the first N-channel MOS transistor 11*c* forms a CMOS inverter. The output terminal and input terminal of the CMOS inverter are short-circuited so that the logical threshold potential Vthinv can be obtained. The second P-channel MOS transistor 11*b* forming the switch circuit 5 is provided in the CMOS inverter.

The substrate biasing circuit shown in FIG. 5 supplies the substrate bias potential to the substrate bias (N-type well) for the first P-channel MOS transistor 11*a*.

The substrate biasing circuit shown in FIG. 5 is equipped with a second N-channel MOS transistor 11*d*, which is an optional element. The drain of the second N-channel MOS transistor 11*d* is connected to the output terminal of the potential compare control circuit 3, and the source thereof is connected to the low-potential power supply voltage VSS. The gate of the second N-channel MOS transistor 11*d* receives the reset input, which may be generated by an internal circuit (not shown) of a device equipped with the substrate biasing circuit shown in FIG. 5 or may be supplied from an external circuit provided outside of the device. The second N-channel MOS transistor 11*d* can force the second P-channel MOS transistor 11*b* to be turned ON.

An inverter 12 is provided between the substrate bias generating circuit 4 and the potential compare control circuit 3. When the output of the potential compare control circuit 3 is low, the substrate bias generating circuit 4 receives the high-level signal.

When the logical threshold potential Vthinv is higher than the reference potential Vref, the output of the potential compare control circuit 3 is switched to the low level, and the second P-channel MOS transistor 11*b* is turned ON. The substrate bias generating circuit 4 operates in response to the high-level signal from the inverter 12, and generates the substrate voltage Vsub so that the potential of the N-type well of the first P-channel MOS transistor 11*a* becomes greater. Hence, the threshold potential of the first P-channel MOS transistor 11*a* is increased, and thus the logical threshold potential Vthinv of the CMOS inverter made up of the first P-channel MOS transistor 11*a* and the first N-channel MOS transistor 11*c* is reduced. When the logical threshold potential Vthinv becomes equal to or lower than the reference potential Vref, the output of the potential compare control circuit 3 is switched to the high level. Then, the substrate bias generating circuit 4 receives the low-level signal from the inverter 12 and stops operating. The substrate potential Vsub obtained at that time is held in the reference bias generating circuit 4. When the output of the potential compare control circuit 3 is switched to the high level, the second P-channel MOS transistor 11*b* is turned OFF. Hence, it is possible to prevent the pass-through current from flowing in the pass-through current path in the substrate bias generating circuit 4.

The second N-channel MOS transistor 11*d*, which is an optional element as described previously, can turn ON the second P-channel MOS transistor 11*b* in response to the reset signal even when the control potential Vcnt output by the potential compare control circuit 3 is at the high level. Hence, the reset input can be used not only to activate the initial operation of the substrate biasing circuit but also to restart the substrate bias generating circuit 4 if the substrate potential Vsub held in the hold circuit (for example, a capacitor) provided in the circuit 4 is decreased.

Figure 6:
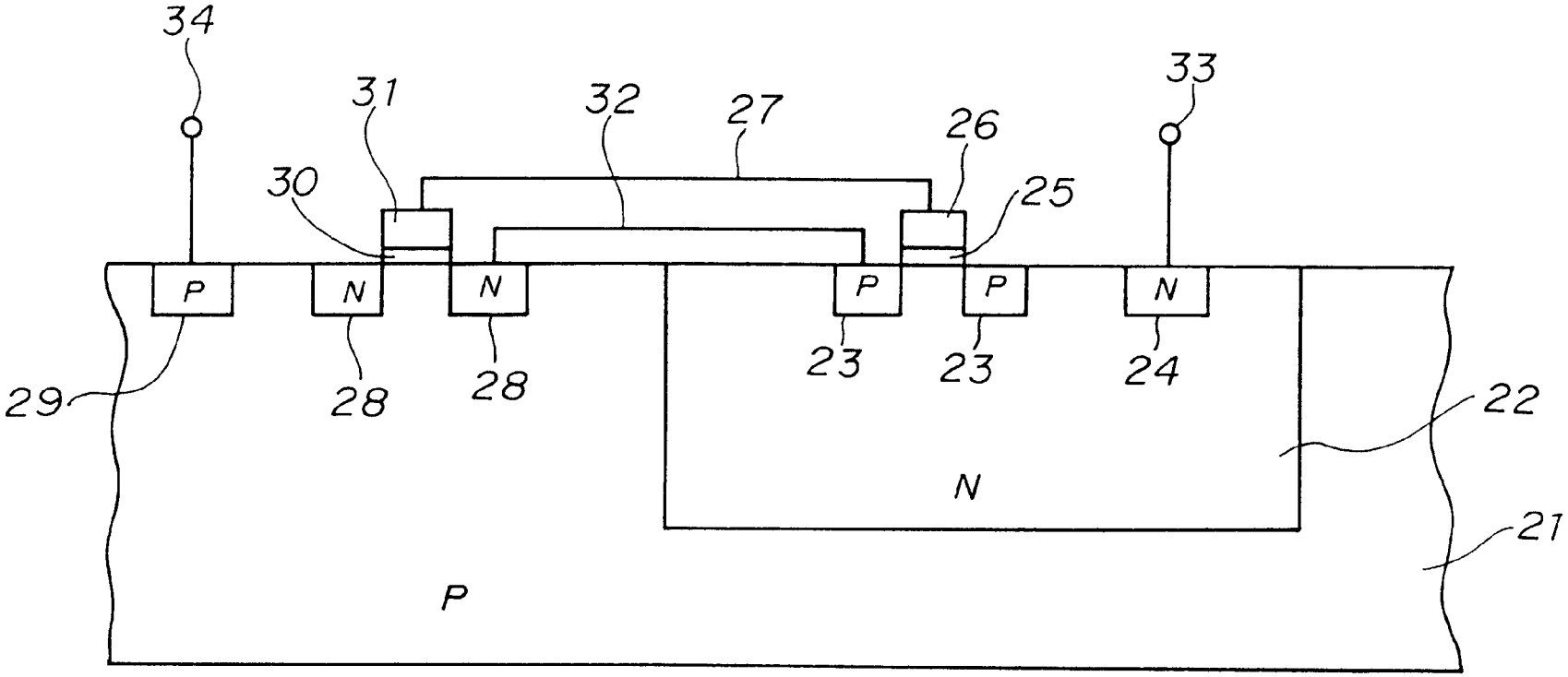
FIG. 6 is a cross-sectional view of a semiconductor integrated circuit device according to an embodiment of the present invention.

FIG. 6 is a cross-sectional view of a semiconductor integrated circuit device equipped with the substrate biasing circuit according to the present invention. The device shown in FIG. 6 has a P-type substrate 21, in which an N-type well 22 is formed. Two P-type impurity diffused regions 23 and an N-type impurity diffused regions 24 are formed in the N-type well 22, so that a P-channel MOS transistor is formed. Further, two N-type impurity diffused regions 28 and a P-type impurity diffused region 29 are formed in the P-type substrate 21 so that an N-channel MOS transistor is formed. A gate insulating film 25 is provided on the surface of the N-type well 22, and a gate electrode 26 is provided on the gate insulating film 25. Similarly, a gate insulating film 30 is provided on the surface of the P-type substrate 21, and a gate electrode 31 is provided on the gate insulating film 30. In the case shown in FIG. 6, the gate electrodes 26 and 31 are connected together by an interconnection line 27, and one of the P-type impurity diffused regions 23 and one of the N-type impurity diffused regions 28 are connected together by an interconnection line 32.

The N-type impurity diffused region 24 functions as a substrate bias terminal for the P-channel MOS transistor, and can be connected to the output terminal of the substrate biasing circuit shown in FIG. 5 via a terminal 33. Hence, the N-type well 22 can be set at the substrate voltage Vsub defined by the reference bias generating circuit 4 shown in FIG. 5.

Similarly, the P-type impurity diffused region 29 functions as a substrate bias terminal for the N-channel MOS transistor, and can be connected to the output terminal of the substrate biasing circuit shown in FIG. 4 via a terminal 34. Hence, the P-type substrate 21 can be set at the substrate voltage Vsub defined by the reference bias generating circuit 4 shown in FIG. 4.

Figure 7:
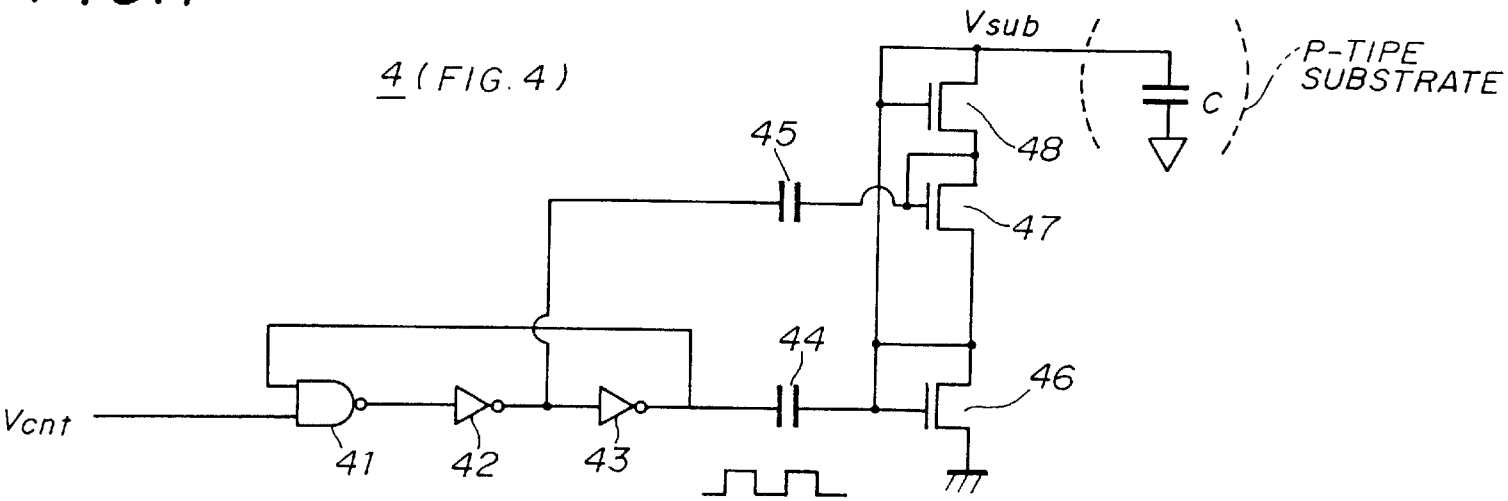
FIG. 7 is a circuit diagram of a substrate bias generating circuit shown in FIG. 4.

FIG. 7 is a circuit diagram of the substrate bias generating circuit 4 shown in FIG. 4, which defines the substrate potential Vsub for the P-type substrate. The substrate bias generating circuit 4 shown in FIG. 4 is made up of a NAND gate 41, two inverters 42 and 43, two coupling capacitors 44 and 45, and three N-channel MOS transistors 46, 47 and 48. A ring oscillator is formed by the NAND gate 41, and the inverters 42 and 43. In response to the control potential Vcnt output by the potential compare control circuit 3, the ring oscillator 43 generates a pulse signal. The output terminal of the inverter 43 is coupled to the gates of the N-channel MOS transistors 46 and 48 through the capacitor 44, and the output terminal of the inverter 42 is coupled to the gate of the N-channel MOS transistor 47 through the capacitor 45. The drain of the N-channel MOS transistor 46 is grounded, and the source thereof is connected to the gate thereof and the drain of the N-channel MOS transistor 47. The source of the N-channel MOS transistor 47 is connected to the gate thereof and the drain of the N-channel MOS transistor 48. The source of the N-channel MOS transistor 48 is connected to the gate and a parasitic capacitor C formed in the P-type substrate 21 shown in FIG. 6, and is further connected to the P-type impurity diffused region 29 shown in FIG. 6 via the terminal 34. The parasitic capacitance C functions to hold the substrate potential Vsub generated as follows.

When the output signal of the inverter 43 switches from the low level to the high level, the N-channel MOS transistors 46 and 48 are turned ON. At this time, the output signal of the inverter 42 is switched to the low level, and thus the N-channel MOS transistor 47 is turned OFF. The potential of the gate and source of the transistor 46 is lower than the drain potential (ground potential) by the threshold voltage thereof.

Then, the output signal of the inverter 42 switches from the low level to the high level, and the output signal of the inverter 43 switches from the high level to the low level. Thus, the N-channel MOS transistor 47 is turned ON and the N-channel MOS transistors 46 and 48 are turned OFF. The potential of the gate and source of the N-channel MOS transistor 47 is lower than the drain potential thereof by the threshold voltage thereof. When the N-channel transistor 47 is turned ON, the potential of the drain thereof is lower than the ground potential by the threshold voltage of the N-channel MOS transistor 46. Hence, the potential of the source and gate of the N-channel MOS transistor 47 is lower than the ground potential by the sum of the threshold voltages of the transistors 46 and 47.

Then, the output signal of the inverter 42 switches from the high level to the low level, and the output signal of the inverter 43 switches from the low level to the high level. Thus, the transistors 46 and 47 are turned ON, and the transistor 47 is turned OFF. The potential of the gate and source of the N-channel MOS transistor 48 is lower than the potential of the drain thereof by the threshold voltage of the transistor 48, and is thus lower than the ground potential by the sum of the threshold voltages of the N-channel MOS transistors 46, 47 and 48.

The substance potential Vsub thus generated is applied to the P-type impurity diffused region 29 shown in FIG. 6. The ring oscillator continues to oscillate after the control potential Vcnt becomes to the low level. Hence, the substrate bias generating circuit 4 continues to operate and the substrate potential Vsub is maintained in the parasitic capacitor C.

Figure 8:
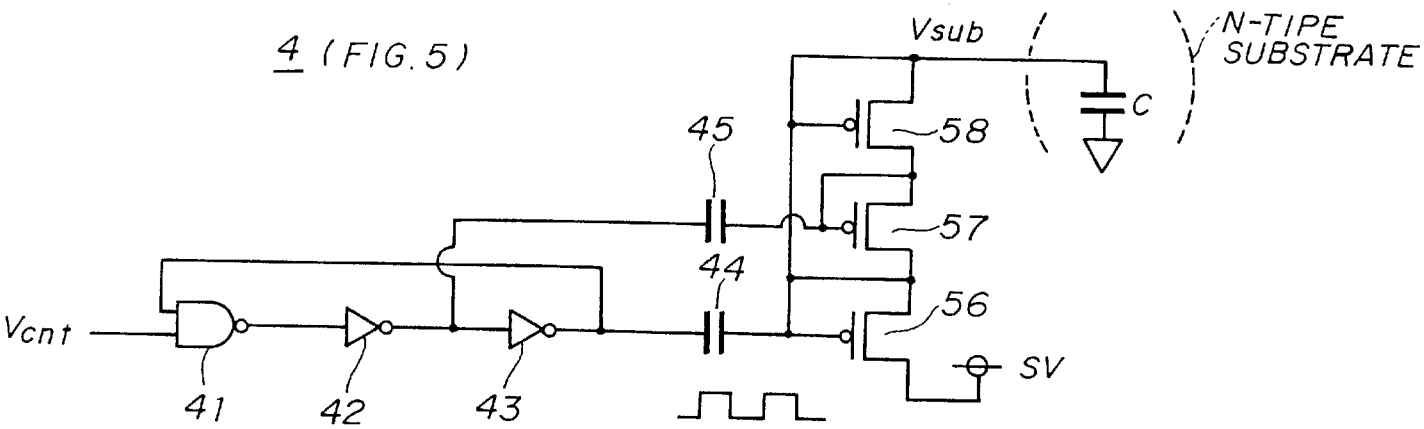
FIG. 8 is a circuit diagram of a substrate bias generating circuit shown in FIG. 5.

FIG. 8 is a circuit diagram of the substrate bias generating circuit 4 shown in FIG. 5, which defines the substrate potential Vsub for the N-type substrate. In FIG. 8, parts that are the same as those shown in FIG. 7 are given the same reference numbers. The substrate bias generating circuit 4 shown in FIG. 5 has the ring oscillator made up of the NAND gate 41, and the inverters 42 and 43, the coupling capacitors 44 and 45, and three P-channel MOS transistors 56, 57 and 58. The drain of the P-channel MOS transistor 56 is connected to the high-potential power supply voltage VDD (equal to 5 V in the configuration shown in FIG. 8). The gate and source of the P-channel MOS transistor 56 are connected together and are connected to the drain of the P-channel MOS transistor 57. The gate and source of the P-channel MOS transistor 57 is connected together and are connected to the drain of the P-channel MOS transistor 58. The gate and source of the P-channel MOS transistor 58 are connected together and are connected to a parasitic capacitor C formed in the N-type substrate (well) 22 shown in FIG. 6. The substrate potential Vsub obtained at the gate and source of the P-channel transistor 58 is applied to the N-type impurity diffused region 24 shown in FIG. 6 via the terminal 33.

When the output signal of the inverter 42 switches from the low level to the high level, and the output signal of the inverter 43 switches from the high level to the low level, the P-channel MOS transistors 56 and 58 are turned ON, and the P-channel MOS transistor 57 is turned OFF. The potential of the gate and source of the P-channel MOS transistor 56 is higher than the power supply voltage 5 V by the threshold voltage thereof.

Then, the output signal of the inverter 42 switches to the low level and the output signal of the inverter 43 switches to the high level. Thus, the P-channel MOS transistors 56 and 58 are turned OFF and the P-channel MOS transistor 57 is turned ON. The potential of the gate and source of the P-channel MOS transistor 57 is higher than the drain potential thereof by its threshold voltage, and is thus higher than 5 V by the sum of the threshold voltages of the transistors 56 and 57.

Then, the output signal of the inverter 42 switches to the high level and the output signal of the inverter 43 switches to the low level. Thus, the P-channel MOS transistors 56 and 58 are turned ON, and the P-channel MOS transistor 57 is turned OFF. The potential of the P-channel MOS transistor 58 is higher than the drain potential thereof by its threshold voltage, and is thus higher than 5 V by the sum of the threshold voltages of the transistors 56, 57 and 58.

The substrate potential Vsub thus generated is held in the parasitic capacitor C formed in the N-type substrate or well 22.

Figure 9:
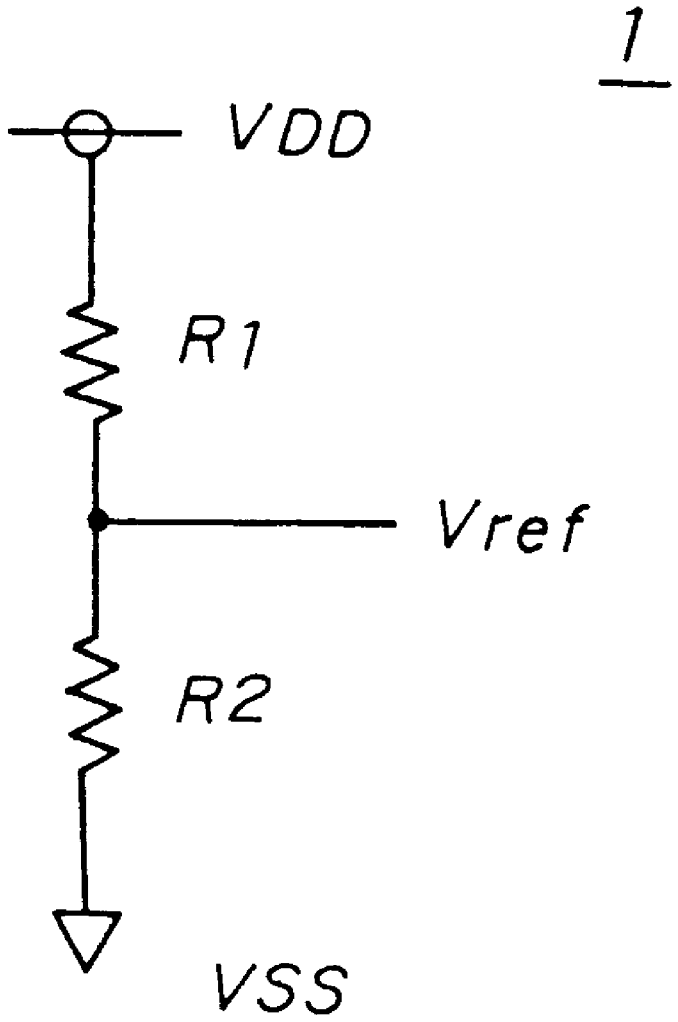
FIG. 9 is a circuit diagram of a reference potential output circuit shown in FIG. 3.

FIG. 9 is a circuit diagram of an example of the reference voltage output circuit 1 shown in FIG. 3. The reference voltage output circuit 1 is made up of two resistors R1 and R2 connected in series between the power supply voltages VDD and VSS. The reference potential Vref can be obtained via a connection node at which the resistors R1 and R2 are connected in series.

The semiconductor integrated circuit device according to the present invention shown in FIG. 6 includes at least the logical threshold potential output circuit 2, the potential compare control circuit 3, the substrate bias generating circuit 4 and the switch 5 shown in FIG. 3, these circuits being formed on the same substrate as shown in FIG. 6. That is, the reference potential output circuit 1 of the substrate biasing circuit 1 may be provided as an external circuit with respect to the semiconductor integrated circuit device. Similarly, the second P-channel MOS transistor 10*d* shown in FIG. 4 and the second N-channel MOS transistor 11*d* shown in FIG. 5 may be formed on the same substrate as shown in FIG. 6 or may be external elements with respect to the semiconductor integrated circuit device.

It is possible to employ either the substrate biasing circuit shown in FIG. 4 or the substrate biasing circuit shown in FIG. 5. It is also possible to employ both the substrate biasing circuits shown in FIGS. 4 and 5.

The high-potential power supply voltage VDD is not limited to 5 V or 3.3 V but can be set to an arbitrary level. For example, a step-down voltage obtained by stepping down the power supply voltage VDD can be used. The present invention is particularly advantageous to situations in which circuits are driven by a comparatively low power supply voltage.

The present invention is not limited to the specifically disclosed embodiments, and variations and modifications may be made without departing from the scope of the present invention.

What is claimed is:

1. A substrate biasing circuit comprising:

a logical threshold potential output circuit including transistors formed on a semiconductor substrate and generating a logical threshold potential;

a potential compare control circuit comparing the logical threshold potential with a reference potential and generating a control potential based on a comparison result;

a substrate bias generating circuit which generates a substrate potential to be applied to the semiconductor substrate so that the logical threshold potential becomes equal to the reference potential and which stops operating after the logical threshold potential becomes equal to the reference potential; and a switch circuit which operates to prevent a pass-through current from flowing in the logical threshold potential output circuit when the control potential indicates that the logical threshold potential is equal to the reference potential.

2. The substrate biasing circuit as claimed in claim 1, further comprising a reset circuit which causes the switch circuit to form the pass-through current path in the logical threshold potential output circuit.

3. The substrate biasing circuit as claimed in claim 1, wherein:

the switch circuit comprises a first N-channel MOS transistor, and the logical threshold potential output circuit comprises a first P-channel MOS transistor and a second N-channel MOS transistor;

the first P-channel MOS transistor, the first N-channel MOS transistor and the second N-channel MOS transistor are connected in series in that order;

the logical threshold potential is obtained at a node at which a gate and drain of the first P-channel MOS transistor, a gate of the second N-channel MOS transistor, and a drain of the first N-channel MOS transistor are connected together; and a gate of the first N-channel MOS transistor is connected to an output terminal of the potential compare control circuit.

4. The substrate biasing circuit as claimed in claim 3, further comprising a second P-channel MOS transistor having a source receiving a high-potential power supply voltage, a drain connected to the gate of the first N-channel MOS transistor, and a gate receiving a reset input.

5. The substrate biasing circuit as claimed in claim 1, wherein:

the logical threshold potential output circuit comprises a first P-channel MOS transistor and a first N-channel MOS transistor, and the switch circuit comprises a second P-channel MOS transistor;

the first P-channel MOS transistor, the second P-channel MOS transistor and the first N-channel MOS transistor are connected in series in that order;

the logical threshold potential is obtained at a node at which a gate and drain of the first N-channel MOS transistor, a gate of the first P-channel MOS transistor, and a drain of the second P-channel MOS transistor are connected together; and a gate of the second P-channel MOS transistor is connected to an output terminal of the potential compare control circuit.

6. The substrate biasing circuit as claimed in claim 5, further comprising a second N-channel MOS transistor having a source receiving a low-potential power supply voltage, a drain connected to the gate of the second P-channel MOS transistor, and a gate receiving a reset input.

7. The substrate biasing circuit as claimed in claim 1, further comprising a reference potential output circuit outputting the reference potential.

8. A semiconductor integrated circuit device comprising:

a semiconductor substrate; and a substrate biasing circuit formed on said substrate, the substrate biasing circuit comprising:

a logical threshold potential output circuit including transistors formed on the semiconductor substrate and generating a logical threshold potential;

a potential compare control circuit comparing the logical threshold potential with a reference potential and generating a control potential based on a comparison result;

a substrate bias generating circuit which generates a substrate potential to be applied to the semiconductor substrate so that the logical threshold potential becomes equal to the reference potential and which stops operating after the logical threshold potential becomes equal to the reference potential; and a switch circuit which operates to prevent a pass-through current from flowing in the logical threshold potential output circuit when the control potential indicates that the logical threshold potential is equal to the reference potential.

9. The semiconductor integrated circuit device as claimed in claim 8, wherein the substrate bias generating circuit generates the substrate potential applied to a P-type region formed in the semiconductor substrate.

10. The semiconductor integrated circuit device as claimed in claim 8, wherein the substrate bias generating circuit generates the substrate potential applied to an N-type region formed in the semiconductor substrate.

11. The semiconductor integrated circuit device as claimed in claim 8, wherein:

the substrate bias generating circuit generates the substrate potential applied to one of a P-type region and an N-type region formed in the semiconductor substrate; and the semiconductor integrated circuit device comprises another substrate bias generating circuit which generates another substrate potential applied to the other one of the P-type region and the N-type region.

* * * * *